United States Patent [19]

Lysenko et al.

[11] Patent Number: 4,624,758

[45] Date of Patent: Nov. 25, 1986

[54] ELECTROCATALYTIC METHOD FOR PRODUCING DIHYDROXYBENZOPHENONES

[75] Inventors: Zenon Lysenko; Eric E. Bancroft, both of Midland, Mich.

[73] Assignee: The Dow Chemical Company, Midland, Mich.

[21] Appl. No.: 816,502

[22] Filed: Jan. 6, 1986

[51] Int. Cl.[4] ..... C07B 29/06; C07C 49/64

[52] U.S. Cl. ..... 204/78; 204/59 R; 204/72; 204/73 R; 204/74; 204/75

[58] Field of Search ..... 204/59 R, 72, 73, 74, 204/75, 78

[56] References Cited

U.S. PATENT DOCUMENTS

| | | | |
|---|---|---|---|
| 2,940,988 | 6/1960 | Coppinger | 260/396 |
| 3,102,124 | 8/1963 | Mitchell | 260/396 |
| 3,291,837 | 12/1966 | Goldberg et al. | 260/591 |
| 3,509,031 | 4/1970 | Covitz | 204/78 |
| 3,592,748 | 7/1971 | Wehrli | 204/78 |
| 3,616,323 | 10/1971 | Covitz | 204/78 |
| 3,663,381 | 5/1972 | Covitz et al. | 204/78 |
| 3,758,391 | 9/1973 | Anderson et al. | 204/78 |
| 3,894,094 | 7/1975 | Rutledge | 260/620 |
| 3,897,319 | 7/1975 | Anderson et al. | 204/78 |
| 3,925,172 | 12/1975 | Voorhies | 204/72 |
| 3,937,741 | 2/1976 | Greco | 204/74 |
| 4,032,547 | 6/1977 | Bacha et al. | 260/396 N |
| 4,056,539 | 11/1977 | Greenwald | 260/326.14 R |
| 4,061,548 | 12/1977 | Jones et al. | 204/78 |
| 4,203,811 | 5/1980 | Cramer | 204/78 |
| 4,311,565 | 1/1982 | Bersier et al. | 204/737 |
| 4,421,613 | 12/1983 | Goodridge et al. | 204/59 R |
| 4,468,236 | 8/1984 | Noding | 204/78 |
| 4,518,535 | 5/1985 | Naarmann et al. | 260/438.1 |
| 4,554,389 | 11/1985 | Shin et al. | 566/172.2 |

*Primary Examiner*—Arthur P. Demers

[57] ABSTRACT

A method for producing dihydroxybenzophenones by the electrocatalytic oxidation of bis(4-hydroxyphenyl) methanes, or the quinone methide intermediate, with 2,3-dichloro-5,6-dicyano-1,4-benzoquinone (DDQ). Spent oxidant, in the form of $DDQH_2$, may be recycled and electrochemically regenerated to active DDQ oxidant.

14 Claims, No Drawings

ELECTROCATALYTIC METHOD FOR PRODUCING DIHYDROXYBENZOPHENONES

BACKGROUND OF THE INVENTION

The present invention relates to a method for the production of dihydroxybenzophenones, and more particularly, it relates to a method for electrocatalytically oxidizing bis(4-hydroxyphenyl)methanes, or the quinone methide intermediate, with 2,3-dichloro-5,6-dicyano-1,4-benzoquinone (DDQ) to produce 4,4'-dihydroxybenzophenones.

Certain benzophenone derivatives are commercially important as light stabilizing additives for various synthetic plastics. See, for example, Goldberg U.S. Pat. No. 3,291,837 wherein 2-hydroxy-3-halopropyl benzophenone ether stabilizing agents are prepared by the catalyzed reaction of a benzophenone intermediate with an epihalohydrin.

Other forms of benzophenones, particularly bisphenol K (4,4'-dihydroxybenzophenone) and substituted bisphenol K, are useful as monomers in the production of synthetic resins. For example, epoxy resins, which are useful as coatings, adhesives and casting resins, can be prepared from the reaction of a bisphenol and epichlorohydrin. Likewise, polycarbonate resins, which are useful as coatings and casting resins, can be prepared from the reaction of a bisphenol and phosgene.

Accordingly, the need exists for a process by which large quantities of dihydroxybenzophenones can be produced economically and at high yields.

SUMMARY OF THE INVENTION

In accordance with the present invention, there is provided a method for economically producing large amounts of dihydroxybenzophenones of the type

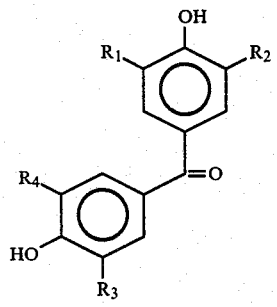

(I)

where $R_1$, $R_2$, $R_3$ and $R_4$ are either alike or different and are hydrogen, straight or branched chain alkyl moieties, cyclic alkyl compounds, halogen compounds, hydroxy and methoxy groups, and combinations thereof.

The instant method for preparing dihydroxybenzophenones of this type involves the oxidation of bis(4-hydroxyphenyl)methanes having the formula

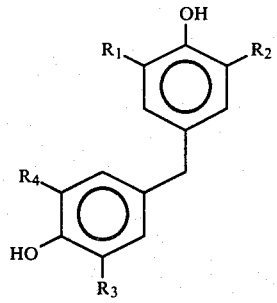

(II)

where $R_1$, $R_2$, $R_3$ and $R_4$ are as in formula (I).

Under some conditions, it has been found that the reaction proceeds through a quinone methide intermediate having the formula

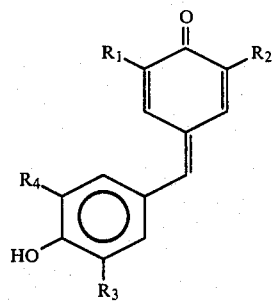

(III)

where $R_1$, $R_2$, $R_3$ and $R_4$ are, again, as in formula (I). Thus, it is possible to produce dihydroxybenzophenones of formula (I) directly from the quinone methide intermediates of formula (II). Quinone methides may be produced for that purpose by a number of known processes or may be produced by the processes disclosed in our copending applications Ser. No. 816,501, Jan. 6, 1986 and Ser. No. 816,503 filed on an even date herewith.

The oxidant used to oxidize the bis(4-hydroxyphenyl)methanes of formula (II) to the dihydroxybenzophenones of formula (I) is 2,3-dichloro-5,6-dicyano-1,4-benzoquinone (DDQ). It has the formula

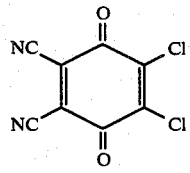

(IV)

Preferably, the process is an electrocatalytic one wherein the DDQ oxidant is used in a homogeneous solution in the anode compartment of an electrochemical cell, which may contain for example a platinum anode. The potential applied may vary between 0.65 and 1.4 V vs. SCE and more preferably between 0.75 and 1.2 V vs. SCE and most preferably from 0.75–0.95 V vs. SCE. Under these conditions, the DDQ may be used in catalytic (i.e. less than stoichiometric) amounts, i.e. between 10 and 100 mole percent relative to the starting material. Likewise, since $DDQH_2$ is electrolytically oxidizable to DDQ it is possible to use $DDQH_2$ as the starting oxidant material. Since $DDQH_2$ is the form of the spent DDQ oxidant, it may be recycled and regenerated in situ in the process. It is not necessary to isolate either DDQ or $DDQH_2$ from the solution. $DDQH_2$ has the formula

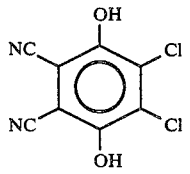

(V)

As such, the overall electrocatalytic oxidation process can be expressed as follows:

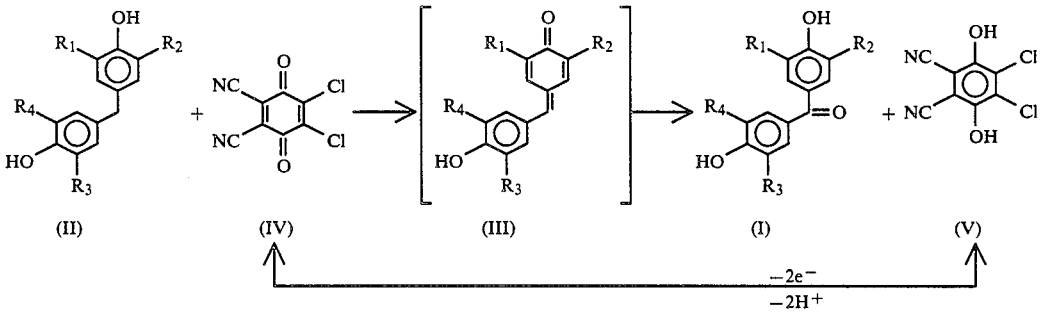

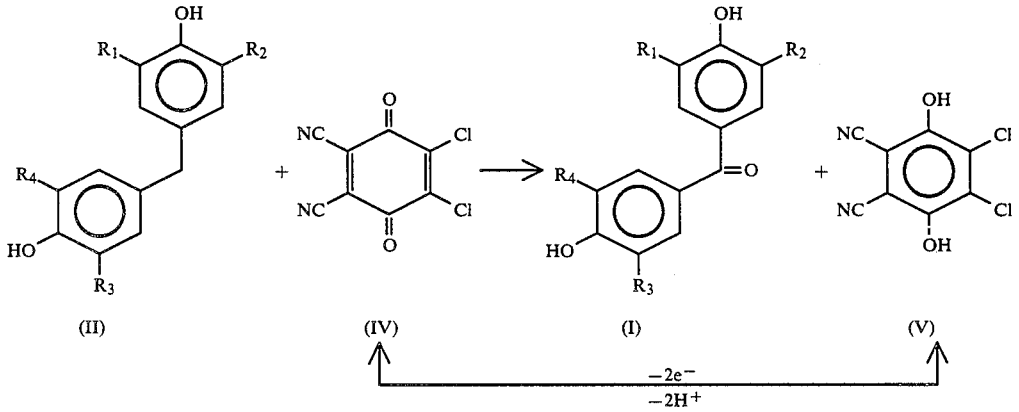

The conversion of the bis(4-hydroxyphenyl)methane of formula (II) to the dihydroxybenzophenone of formula (I) is accomplished by the DDQ of formula (IV) acting as an oxidant in homogeneous solution with the bis(4-hydroxyphenyl)methane of formula (II). The spent oxidant, $DDQH_2$ of formula (V) may, then, be recycled and regenerated to DDQ (formula IV) by electrooxidation at an electrode potential which is insufficient to directly oxidize the bis(4-hydroxyphenyl)methane of formula (II).

As mentioned, with some bis(4-hydroxyphenyl)methanes, such as the tetramethyl variety, it has been found that the reaction proceeds through the quinone methide intermediate of formula (III). In other instances, such as when the starting material is 4,4'-dihydroxydiphenyl methane, the intermediate, if any, is transient. In that instance, the overall reaction is better expressed as follows:

When a quinone methide intermediate is used as the starting material, then, the conversion to the dihydroxybenzophenone can be expressed as follows:

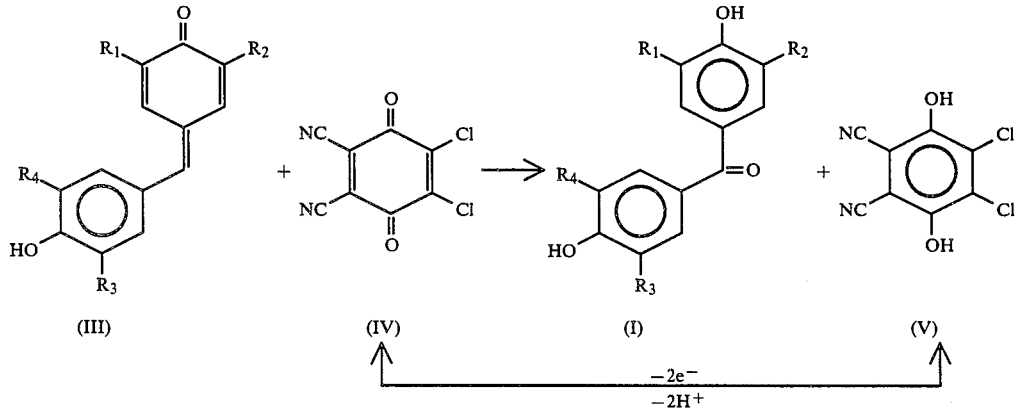

In any event, the result is an efficient, economical, high yield process for the production of the dihydroxybenzophenones of formula (I) which, as mentioned, find utility as light stabilizing agents and precursors for the production of epoxy resins, polycarbonate resins, and other thermoplastics.

Accordingly, it is an object of the present invention to provide an inexpensive means to produce large quantities of dihydroxybenzophenones.

Other objects and advantages of the invention will become apparent from the following description and the accompanying claims.

DETAILED DESCRIPTION OF THE PREFERRED EMBODIMENTS

The preferred method is a catalytic oxidation reaction carried out in an electrochemical cell at room temperature and pressure. A divided batch electrochemical cell is fitted with working and auxiliary electrodes and a suitable reference electrode such as a saturated calomel reference electrode (SCE). The cathode (auxiliary) compartment is filled with a supporting electrolyte solution. Any number of solvent/supporting electrolyte solutions can be used so long as they provide acceptable solubilities for bis(4-hydroxyphenyl)methanes, quinone methides, DDQ, and $DDQH_2$, and the dihydroxybenzophenone.

The working electrode is the anode, which may be platinum, carbon or any other inert electrode material which remains stable at the oxidation potential. The anode compartment is filled with the supporting electrolyte solution and the starting materials. The required starting materials include both the oxidation catalyst and the substrate material. The working electrode is then biased to, and maintained at, a constant voltage vs. SCE using a three electrode potentiostat. During electrolysis, the anolyte solution is rapidly stirred using conventional stirring equipment.

In one embodiment, the starting oxidation catalyst placed in the anode compartment is the DDQ of formula (IV). DDQ is a known oxidant as taught by U.S. Pat. Nos. 4,518,535; 4,056,539, and 3,102,124. It may be purchased from Aldrich Chemical Company. In another embodiment, it may be the $DDQH_2$ of formula (V). In that instance, the electrolytic oxidation, at an electrode potential in the range of 0.65 to 1.4 V vs. SCE, oxidizes the $DDQH_2$ to DDQ which, then, serves as the oxidation catalyst. $DDQH_2$ is available as the reduced form of DDQ. Since $DDQH_2$ is produced by the reaction process, it is thus possible to recycle it in situ in the anode compartment. In addition, since the DDQ oxidant is regenerated in situ it may be used in non-stoichiometric quantities in the range of 10 to 100 mole percent relative to the starting substrate material and preferably on the order of 10 mole percent. As a result of all of this, a relatively inexpensive source of oxidant is utilized in the process.

In one embodiment, the starting substrate material placed in the anode compartment is the bis(4-hydroxyphenyl)methane of formula (II). Bis(4-hydroxyphenyl)methanes of formula (II) where $R_1$, $R_2$, $R_3$ and $R_4$ are hydrogen, straight or branched chain alkyl moieties, cyclic alkyl compounds, halogen compounds, hydroxy or methoxy groups, or combinations thereof are available from Aldrich Chemical Company or Dow Chemical Company. In another embodiment, the starting substrate material may be quinone methide of formula (III). Quinone methides of this type can be produced by the method disclosed in Coppinger U.S. Pat. No. 2,940,988. Coppinger teaches oxidation of dihydroxydiphenyl methane using a lead dioxide or lead tetraacetate oxidant to produce a stable free radical which can be reduced to quinone methide. Preferred sources for a quinone methide starting material are the methods disclosed in our copending applications Ser. No. 816,501 and Ser. No. 816,503, which disclose (1) production of quinone methide by electrocatalytic oxidation of bis(4-hydroxyphenyl)methane using DDQ and (2) production of quinone methide by electrolytic oxidation of bis(4-hydroxyphenyl)methane, respectively. Should the electrocatalytic process be used to prepare a quinone methide starting material, it is not necessary to separate the quinone methide from the DDQ and $DDQH_2$ prior to its use in the present process. Rather, those impurities are active ingredients in the present electrocatalytic process which in this instance can be considered a continuation of that disclosed in Ser. No. 816,501. Should a pure quinone methide starting material be desired, then, the electrolytic process of Ser. No. 816,503 would probably be preferred for economic reasons.

With any of these embodiments, the starting materials are dissolved in the supporting electrolyte solution in the anode compartment and stirred during application of a constant voltage vs. SCE of between 0.65 V and 1.40 V and most preferably of approximately 0.75 V–0.95 vs. SCE. The electrolysis is allowed to come to equilibrium. Dihydroxybenzophenone is produced in yields of 75 to 95% and is isolated by evaporating the solvent and filtering off the solid dihydroxybenzophenone as it precipitates out. The dihydroxybenzophenone can be separated from any co-precipitated DDQ by dissolving the dihydroxybenzophenone in acetic acid, filtering out the DDQ, and, then, re-precipitating the dihydroxybenzophenone.

The following example is illustrative.

EXAMPLE

This example illustrates the preparation of 3,3′,5,5′-tetramethyl-4,4′-dihydroxybenzophenone. A divided batch electrochemical cell was fitted with platinum working and auxiliary electrodes and a saturated calomel reference electrode (SCE). The cathode (auxiliary) compartment was filled with an electrolyte solution which contained 0.25M sodium acetate dissolved in one part by volume of acetic acid and four parts of acetonitrile. The anode (working) compartment was charged first with one volume of water and then filled with five volumes of the electrolyte solution to which had been added 40 g. bis(3,5-dimethyl-4-hydroxyphenyl)methane and 36 g. $DDQH_2$ per liter of electrolyte. The anode was then biased to 0.75 volts vs. SCE until equilibrium was reached (overnight). At that point in time, an 87–89% yield of 3,3′,5,5′-tetramethyl-4,4′-dihydroxybenzophenone was found to have been produced in 87–89% yield. One hundred percent of the bis(3,5-dimethyl-4-hydroxyphenyl)methane was found to have been consumed.

While the methods herein described constitute preferred embodiments of the invention, it is to be understood that the invention is not limited to these precise methods and that changes may be made in the method without departing from the scope of the invention, which is defined in the appended claims.

What is claimed is:

1. A process for preparing dihydroxybenzophenones from bis(4-hydroxyphenyl)methanes comprising electrocatalytically oxidizing a bis(4-hydroxyphenyl)methane having the formula

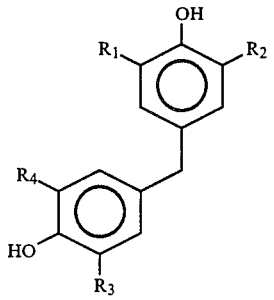

wherein $R_1$, $R_2$, $R_3$, and $R_4$ are either alike or different members selected from the group consisting of hydrogen, straight or branched chain alkyl moieties, cyclic alkyl compounds, halogen compounds, hydroxy and methoxy compounds, and combinations thereof, utilizing as an oxidant 2,3-dichloro-5,6-dicyano-1,4-benzoquinone having the formula

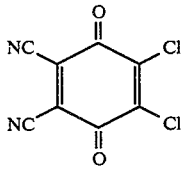

to produce spent oxidant and a dihydroxybenzophenone having the formula

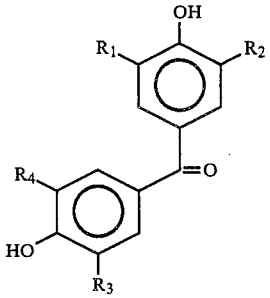

wherein $R_1$, $R_2$, $R_3$ and $R_4$ are as previously recited.

2. The process of claim 1 wherein said spent oxidant is electrochemically oxidized to its active form and recycled in the process.

3. The process of claim 1 wherein said oxidant is present in the amount of 10 to 100 mole percent relative to said bis(4-hydroxyphenyl)methane.

4. The process of claim 3 wherein said oxidant is present in the amount of approximately 10 mole percent relative to said bis(4-hydroxyphenyl)methane.

5. The process of claim 1 wherein said oxidation takes place in the presence of a platinum anode at a constant voltage of 0.65 to 1.40 V vs. SCE for a period of time sufficient to produce a 75 to 95% yield of dihydroxybenzophenone.

6. The process of claim 1 wherein said bis(4-hydroxyphenyl)methane is bis(3,5-dimethyl-4-hydroxyphenyl)methane and said dihydroxybenzophenone is 3,3',5,5'-tetramethyl-4,4'-dihydroxybenzophenone.

7. The process of claim 6 wherein said oxidant is present in the amount of approximately 10 mole percent, relative to said bis(4-hydroxyphenyl)methane, said constant voltage is approximately 0.75 V–0.95 vs. SCE, and said reaction is carried out to equilibrium.

8. A process for preparing dihydroxybenzophenones from quinone methide comprising electrocatalytically oxidizing a quinone methide having the formula

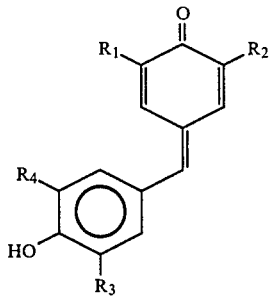

wherein $R_1$, $R_2$, $R_3$ and $R_4$ are either alike or different members selected from the group consisting of hydrogen, straight or branched chain alkyl moieties, cyclic alkyl compounds, halogen compounds, hydroxy and methoxy compounds, and combinations thereof, utilizing as an oxidant 2,3-dichloro-5,6-dicyano-1,4-benzoquinone having the formula

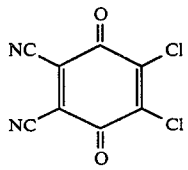

to produce spent oxidant and a dihydroxybenzophenone having the formula

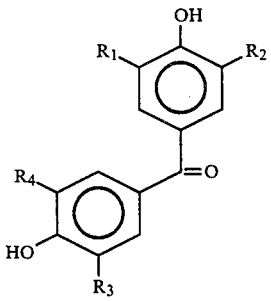

wherein $R_1$, $R_2$, $R_3$ and $R_4$ are as previously recited.

9. The process of claim 8 wherein said spent oxidant is electrochemically oxidized to its active form and recycled in the process.

10. The process of claim 8 wherein said oxidant is present in the amount of 10 to 100 mole percent relative to said quinone methide.

11. The process of claim 10 wherein said oxidant is present in the amount of approximately 10 mole percent relative to said quinone methide.

12. The process of claim 8 wherein said quinone methide is the quinone methide of bis(3,5-dimethyl,4-hydroxyphenyl)methane and said dihydroxybenzophenone is 3,3',5,5'-tetramethyl-4,4'-dihydroxybenzophenone.

13. The process of claim 8 wherein said oxidation takes place in the presence of a platinum anode at a constant voltage of 0.65 to 1.40 V vs. SCE for a period of time sufficient to produce a 75 to 95% yield of dihydroxybenzophenone.

14. The process of claim 13 wherein said oxidant is present in the amount of approximately 10 mole percent, relative to aid quinone methide, said constant voltage is approximately 0.75 V–0.95 V vs. SCE, and said reaction is carried out to equilibrium.

* * * * *